US007013844B2

(12) United States Patent
Oda

(10) Patent No.: US 7,013,844 B2
(45) Date of Patent: Mar. 21, 2006

(54) ONBOARD FUEL SEPARATION APPARATUS FOR AN AUTOMOBILE

(75) Inventor: Tomihisa Oda, Numazu (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 10/968,255

(22) Filed: Oct. 20, 2004

(65) Prior Publication Data

US 2005/0103285 A1 May 19, 2005

(30) Foreign Application Priority Data

Nov. 7, 2003 (JP) ..... 2003-378672

(51) Int. Cl.
*F02B 43/08* (2006.01)

(52) U.S. Cl. ..... 123/3; 60/285

(58) Field of Classification Search ..... 123/3; 60/285

See application file for complete search history.

(56) References Cited

U.S. PATENT DOCUMENTS 5,132,486 A * 7/1992 Wylie ..... 585/826
6,622,663 B1 * 9/2003 Weissman et al. ..... 123/1 A
6,711,893 B1 * 3/2004 Ueda et al. ..... 60/285

FOREIGN PATENT DOCUMENTS

JP A 5-312115 11/1993

* cited by examiner

*Primary Examiner*—Mahmoud Gimie
*Assistant Examiner*—Katrina B Harris
(74) *Attorney, Agent, or Firm*—Oliff & Berridge, PLC

(57) ABSTRACT

A fuel separation apparatus includes a fuel tank storing the material fuel fed to a separation membrane, a fuel tank storing a separated low-octane fuel, and a fuel tank storing a separated high-octane fuel. An electronic control unit of the separation apparatus calculates the flow rate (amount of formation) of the high-octane fuel flowing into the high-octane fuel tank based on a change in the liquid level in the tank and on the amount of fuel fed to an engine from the tank, and so judges that an abnormal condition is occurring due to the breakage of the separation membrane when the amount of forming the high-octane fuel is larger than a predetermined upper limit value and that an abnormal condition is occurring due to a drop in the function of the separation membrane when the amount of formation is smaller than a predetermined lower limit value.

15 Claims, 7 Drawing Sheets

ONBOARD FUEL SEPARATION APPARATUS FOR AN AUTOMOBILE

BACKGROUND OF THE INVENTION

1. Field of the Invention

The present invention relates to an onboard fuel separation apparatus for an automobile and, more specifically, to an onboard fuel separation apparatus having a separation membrane that separates a material fuel into a high-octane fuel and a low-octane fuel.

2. Description of the Related Art

A technology for separating a material fuel (a fuel used as a raw material) into two kinds of fuels having properties different from the material fuel by using a separation membrane is disclosed in Japanese Unexamined Patent Publication (Kokai) No. 5-312115. According to the '115 publication, the gasoline in a gasoline tank is separated into a low-boiling point fuel (a fuel having a low boiling point) and a high-boiling point fuel (a fuel having a high-boiling point) by using a pervaporation separation membrane, and the low-boiling point fuel is stored in a fuel tank and is fed to the engine at the start of the engine or during the cold operation. According to the apparatus in '115 publication, the low-boiling point fuel separated from the material fuel during the operation of the engine is used for starting the engine or for the cold operation to improve starting performance of the engine and to improve the emission during the cold operation.

As the low-boiling point fuel is separated from an ordinary gasoline in the apparatus of the '115 publication, the startup performance and the exhaust gas property of the engine in the cold operation can be improved by using low-boiling point fuel without requiring a separate supply of the low-boiling point fuel.

According to the apparatus in '115 publication, however, no consideration has been given to the possibility that the material fuel is not normally separated into the low-boiling point fuel and the high-boiling point fuel, i.e., the occurrence of an abnormal condition in the apparatus has not at all been taken into consideration.

For example, in separating the material fuel by utilizing the pervaporation separation membrane as in the above apparatus, if the separation membrane becomes defective by being damaged, the material fuel passes through the separation membrane without being separated. Therefore, a difference in the boiling point becomes narrow between the low-boiling point fuel and the high-boiling point fuel, and the engine starting performance and the emission during the cold operation are not improved despite of using the low-boiling point fuel obtained by separation.

Though, in the foregoing, a separation apparatus for separating the low-boiling point fuel was described, it becomes difficult to maintain desired octane values of the high-octane fuel and of the low-octane fuel if the separation membrane becomes defective in the fuel separating apparatus that separates the material fuel into the high-octane fuel and the low-octane fuel by using the separation membrane. Therefore, it becomes difficult to obtain a desired engine performance during the high-load operation of the engine using the high-octane fuel, at the start of the engine using the low-octane fuel, or during a cold operation.

SUMMARY OF THE INVENTION

In view of the above-mentioned problems, therefore, it is an object of the present invention to provide an onboard fuel separation apparatus equipped with abnormal condition-judging means for taking a countermeasure by detecting any abnormal condition in the separation apparatus quickly.

The object as set forth above is achieved by an onboard fuel separation apparatus provided with a separation membrane which separates a fuel supplied as a material fuel into a high-octane fuel containing fractions of high octane values in amounts larger than that of the material fuel and a low-octane fuel containing fractions of low octane values in amounts larger than that of the material fuel, comprising abnormal condition-judging means for judging whether an abnormal condition is occurring in the fuel separation apparatus based upon the rate of forming of at least either the high-octane fuel or the low-octane fuel after the separation.

Namely, in the present invention, an abnormal condition occurring in the fuel separation apparatus is judged based on the rate of forming the fuel after the separation. For example, if the separation membrane becomes abnormal, there occurs a change in the rate of forming the separated fuel (the rate of forming the fuel after the separation increases) accompanying a change in the properties such as the octane value of the fuel after the separation. Further, if an abnormal condition occurs in the control valve on the fuel passage that introduces the fuel after the separation into the fuel tank, there also occurs a change in the amount of the separated fuel formed in the tank. Therefore, by judging the occurrence of an abnormal condition in the apparatus based on the rate of forming either one of the separated fuels, it becomes possible to correctly judge the occurrence of an abnormal condition in the apparatus during the operation of the fuel separation apparatus.

BRIEF DESCRIPTION OF THE DRAWINGS

The present invention will be better understood from the description, as set forth hereinafter, with reference to the accompanying drawings in which.

DESCRIPTION OF THE PREFERRED EMBODIMENT

An embodiment of the invention will now be described with reference to the accompanying drawings.

Figure 1:
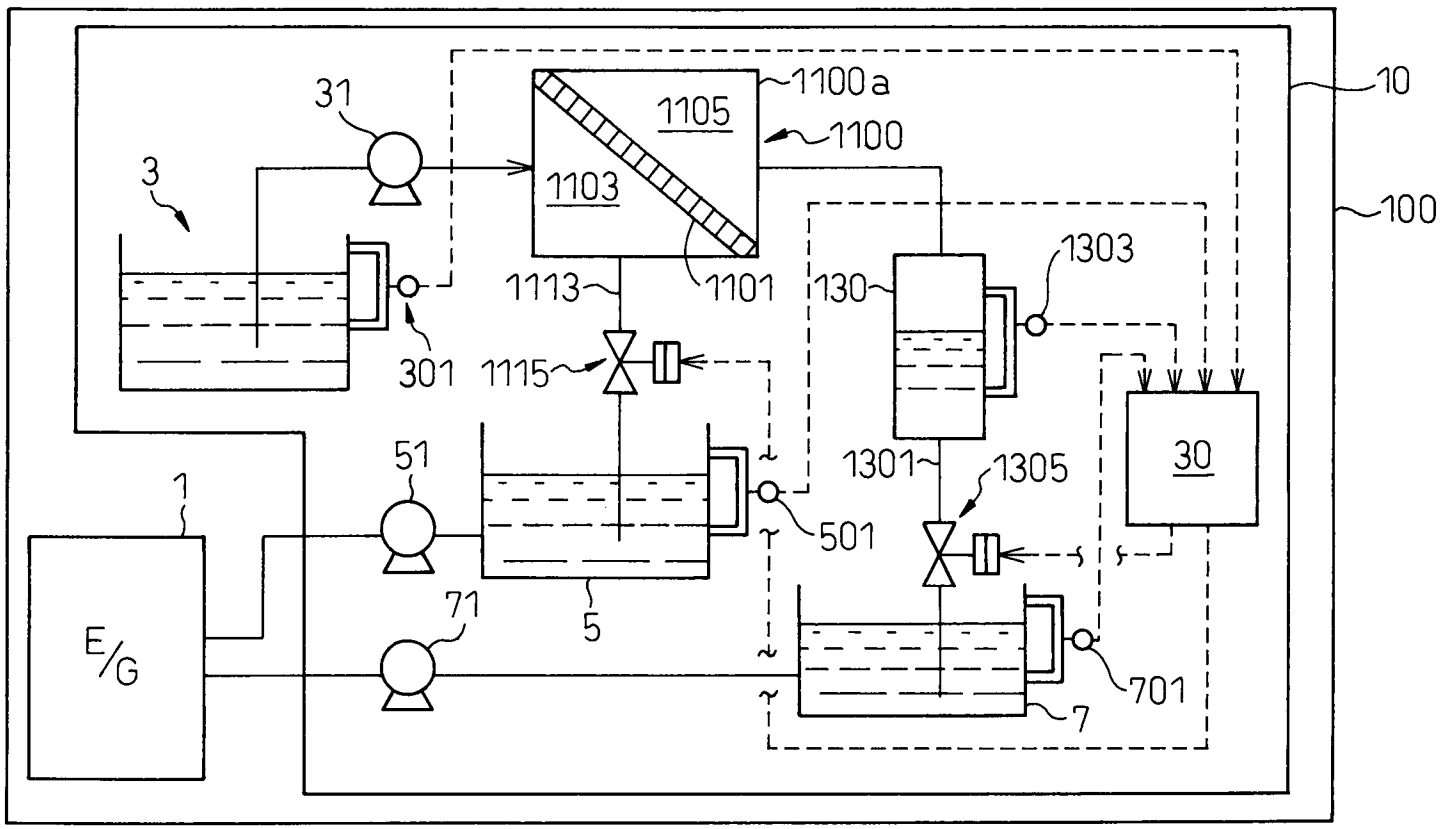
FIG. 1 is a view schematically illustrating a fundamental constitution of an embodiment of an onboard fuel separation apparatus according to the present invention.

FIG. 1 is a diagram schematically illustrating a fundamental constitution of an embodiment of an onboard fuel separation apparatus according to the present invention.

In FIG. 1, reference numeral 1 denotes an internal combustion engine (a gasoline engine is used in this embodiment). In this embodiment, as will be described later, the material gasoline is separated into a high-octane fuel having a high octane value and a low-octane fuel having a low octane value, and these fuels are fed to the engine 1. The engine 1 is operated on either one of the high-octane fuel or the low-octane fuel depending upon the operating conditions of the engine or is operated on both fuels being supplied at a predetermined ratio.

In FIG. 1, reference numeral 3 denotes a fuel tank for storing the fuel (gasoline). Ordinary (commercially available) gasoline is supplied to the tank 3 and stored therein. In this specification, the gasoline stored in the fuel tank 3 is referred to as "material fuel" for making a distinction from the separated fuel that will be described later.

The fuel in the material fuel tank 3 is sent, under pressure, to a fuel separation apparatus 10, that will be described later, by a material fuel pump 31 and there the material fuel is separated into a high-octane fuel having a high octane value and a low-octane fuel having a low octane value. The separated fuels are stored in a tank 5 for the low-octane fuel and in a tank 7 for the high-octane fuel, respectively.

In this embodiment, the separation apparatus 10, and the fuel tanks 3, 5 and 7 are mounted on a vehicle 100 together with the engine 1.

The low-octane fuel in the fuel tank 5 and the high-octane fuel in the fuel tank 7 are fed to the engine 1 through feed pumps 51 and 71, respectively.

In this embodiment as described above, either one of the low-octane fuel or the high-octane fuel is selectively fed, or both fuels are simultaneously fed at a predetermined ratio, to the cylinders of the engine 1 depending upon the operating condition of the engine 1.

In FIG. 1, the fuel separation apparatus which, as a whole, is designated by numeral 10 works to separate the material fuel fed from the fuel tank 3 into the high-octane fuel and the low-octane fuel. The separation apparatus 10 is provided with a separation membrane module 1100 using a separation membrane.

In the separation membrane module 1100, the interior of the housing 1100*a* of the module 1100 is divided into two sections 1103 and 1105 by an aroma components separation membrane 1101.

The aroma components separation membrane 1101 is the one having a property for permitting the selective passage of aromatic components in the gasoline. That is, when the material fuel is fed with a relatively high pressure into one side of the separation membrane (e.g., into the side of the section 1103, i.e., into the side of the low-octane fuel) and when the other side (e.g., the side of the section 1105, i.e., the side of the high-octane fuel) is maintained at a relatively low pressure, the aromatic components in the material fuel mainly pass through the aroma component separation membrane 1101 to ooze out on the surface on the low pressure side of the membrane 1101 (the side of the section 1105 or the side of the high-octane fuel) so as to cover the membrane surface facing the low pressure side 1105.

By removing the liquid fuel, that is oozing out to cover the membrane surface on the low-pressure side, the aromatic components continuously ooze out from the side of the high-pressure section 1103 toward the side of the low-pressure section 1105 passing through the separation membrane 1101. In this embodiment, the pressure on the low-pressure side (on the side of the section 1105) is maintained to be lower than the vapor pressure of the aromatic components that are oozed out, so that the oozed fuel containing much aromatic components covering the membrane surface of the low-pressure side is evaporated and is continuously removed from the surface of the membrane, and is recovered in the form of a fuel vapor.

The fuel vapor recovered from the section 1105 of the low-pressure side in the separation membrane module 1100 is sent to a vapor/liquid separator 130 and is cooled. Therefore, the aromatic components having relatively high boiling points are liquefied, and a high octane value liquid fuel containing a large amount of aromatic components is formed in the lower part of the vapor/liquid separator 130.

As is well known, the octane value (RON: Research Octane Number) of the gasoline increases with an increase in the amount of aromatic components in the gasoline. Therefore, the octane value of the separated fuel containing much aromatic components recovered from the vapor/liquid separator 130 becomes much higher than the octane value of the material fuel. The material fuel remaining in the section 1103 of the high-pressure side of the separation membrane 1101, and containing a decreased amount of high octane value components after the aromatic components have been partly removed therefrom, is recovered as the low-octane fuel having an octane value lower than that of the material fuel.

That is, when the material fuel is fed to the section 1103 of the high-pressure side of the separation membrane module 1100, the high-octane fuel having an octane value higher than that of the material fuel is recovered from the section 1105 of the low-pressure side in the form of a vapor. By separating and recovering the high-octane fuel which is liquefied in the vapor/liquid separator 130, a high-octane fuel is formed.

From the section 1103 of the high-pressure side, further, the fuel having an octane value lower than that of the material fuel (i.e., a low-octane fuel) is recovered as a result of removing part of the high octane value components (aromatic components) from the material fuel. Namely, the material fuel that is fed to the separation membrane module 1100 is separated into the high-octane fuel and the low-octane fuel.

In this embodiment, the separation apparatus 10 mounted on the vehicle separates the material fuel into the high-octane fuel and the low-octane fuel, which are then stored in the tank 5 for the low-octane fuel and in the tank 7 for the high-octane fuel. Either one of the high-octane fuel or the low-octane fuel is fed, or both fuels are fed at a predetermined ratio, to the engine 1, depending upon the engine operating conditions, to improve engine performance and the emission.

The low-octane fuel has a very good igniting property. Therefore, use of the low-octane fuel at the start of the engine or during the cold operation makes it possible to improve the engine performance and the emission. On the other hand, the high-octane fuel is less self-igniting. Therefore, use of the high-octane fuel during the high output operation makes it possible to increase the engine output by advancing the ignition timing.

Referring to FIG. 1, the low-octane fuel flows from the low-pressure section 1103 of the separation membrane module 1100, passes through a low-octane fuel pipe 1113, adjusted for its flow rate through a flow rate control valve 1115, and is stored in the low-octane fuel tank 5. In FIG. 1, reference numeral 501 denotes a level gauge for detecting the amount of the low-octane fuel stored in the low-octane fuel tank 5.

The high-octane fuel flows from the gas/liquid separator 130, passes through the high-octane fuel pipe 1301, and is fed into the high-octane fuel tank 7. As shown in FIG. 1, further, the vapor/liquid separator 130 is provided with a level gauge 1303 for detecting the amount (liquid level) of the high-octane fuel held in the separator 130.

A flow rate control valve 1305 is provided on a high-octane fuel pipe 1301 to control the flow rate of the high-octane fuel that flows through the pipe 1301. In this embodiment, the set value of the flow rate of the flow rate control valve 1305 (i.e., opening degree of the flow rate control valve 1305) is so controlled by an electronic control unit 30, that will be described later, that the liquid level in the vapor/liquid separator 130 becomes a predetermined value as detected by the level gauge 1303.

The high-octane fuel flows from the vapor/liquid separator 130 is adjusted for its flow rate by the flow rate control valve 1305, and flows into the high-octane fuel tank 7 from the pipe 1301 and is stored therein. The high-octane fuel tank 7 is provided with a level gauge 701 for detecting the amount of the high-octane fuel stored in the tank.

In FIG. 1, further, reference numeral 30 denotes an electronic control unit for controlling the separation apparatus 10. The electronic control unit 30 is, for example, a microcomputer of a known constitution and works to control the separating operation of the separation apparatus 10.

To execute the control operation, the electronic control unit 10 receives an output from the level gauge 1303 of the vapor/liquid separator 130, and receives signals corresponding to the liquid levels in the tanks (amounts of fuel in the tanks) from the level gauges 301, 501, 701 of the material fuel tank 3, low-octane fuel tank 5 and high-octane fuel tank 7. The output ports of the electronic control unit 30 are connected to the flow rate control valves 1115 and 1305 to control the opening degrees of these valves, and are further connected to the material fuel feed pump 31 to control the operation of the pump.

To selectively use the high-octane fuel and the low-octane fuel depending upon the engine operating conditions, it is necessary that the difference in the octane value is as large as possible between the high-octane fuel and the low-octane fuel and, besides, the yield of the high-octane fuel is as large as possible.

However, if the separation apparatus 10 becomes abnormal, a difference in the octane value between the separated fuels decreases and it becomes difficult to sufficiently maintain the yield of the high-octane fuel. Besides, it is difficult, while the engine is in operation, to directly measure the octane value of the separated fuels or the yield thereof. Therefore, if the separation apparatus 10 becomes abnormal, the engine would be operated on the separated fuel which does not have a required octane value while the driver does not notice it; i.e., the engine continues to operate in a state where the engine performance has decreased or the emission has deteriorated.

When, for example, the separation membrane 1101 becomes abnormal such as being damaged or perforated, the material fuel flows directly into the low-pressure section 1105 passing through a broken portion of the membrane. Therefore, the high-octane fuel is diluted with the material fuel and this causes a decrease in the octane value of the high-octane fuel.

Further, if the function of the separation membrane drops (amount of passage of aromatic components drops) due to clogging by the adhesion of foreign matter on the surfaces of the separation membrane 1101 or due to the deterioration of the separation membrane, the amount of the high-octane fuel formed by the separation decreases. According to the present invention, the occurrence of an abnormal condition is judged by a method described below while the separation apparatus 10 is in operation, thereby the abnormal condition in the separation apparatus can be found at an early time.

This embodiment judges the occurrence of abnormal conditions of the following types in the separation apparatus 10.

(1) Abnormal condition in the separation membrane.

a. Damage (breakage, holes) in the separation membrane.

b. Drop in the function (clogging, deterioration) of the separation membrane.

(2) Abnormal condition in the flow rate control system.

a. Abnormal condition in the high-octane fuel flow rate control valve (fuel control valve 1305).

b. Abnormal condition in the level sensor 1303 of the vapor/liquid separator.

c. Abnormal condition in the low-octane fuel flow rate control valve (fuel control valve 1115).

Described below are the operations for judging the abnormal conditions.

(1) Abnormal condition in the separation membrane.

If the separation membrane 1101 breaks as described above, the material fuel fed into the high-pressure section 1103 of the separation membrane module 1100 flows into the low-pressure section 1105 through the broken portion, and the amount of fuel recovered in the vapor/liquid separator 130 from the low-pressure section (high-octane fuel side) 1105 increases as compared to when only the aromatic components mainly pass through the separation membrane. In this case, the octane value of the fuel recovered in the vapor/liquid separator 130 as the high-octane fuel decreases since the material fuel is mixed thereto.

On the other hand, the amount of fuel recovered in the low-octane fuel tank from the high-pressure section (low-octane fuel side) 1103 decreases by an amount the high-octane fuel has increased.

Therefore, if the abnormal condition occurs due to the breakage of the separation membrane 1101, the amount of the high-octane fuel formed by the separation increases as compared to that of under the normal condition, and the amount of the low-octane fuel formed decreases.

Further, if the function of the separation membrane drops (passage of aromatic components drops) due to clogging by the adhesion of foreign matter on the separation membrane 1101 or due to the deterioration of the separation membrane, the amount of the high-octane fuel formed by the separation decreases contrary to the above, and the amount of the low-octane fuel formed increases.

That is, the abnormal condition of the separation membrane appears as a change in the amounts of formation of the high-octane fuel and the low-octane fuel after the separation, and the increase or decrease in the amounts of fuels after the separation varies depending upon the kind of the abnormal condition.

The present invention gives attention to the above fact, and judges the occurrence of an abnormal condition in the separation membrane by monitoring the amount of formation of the fuel after the separation.

Figure 2:
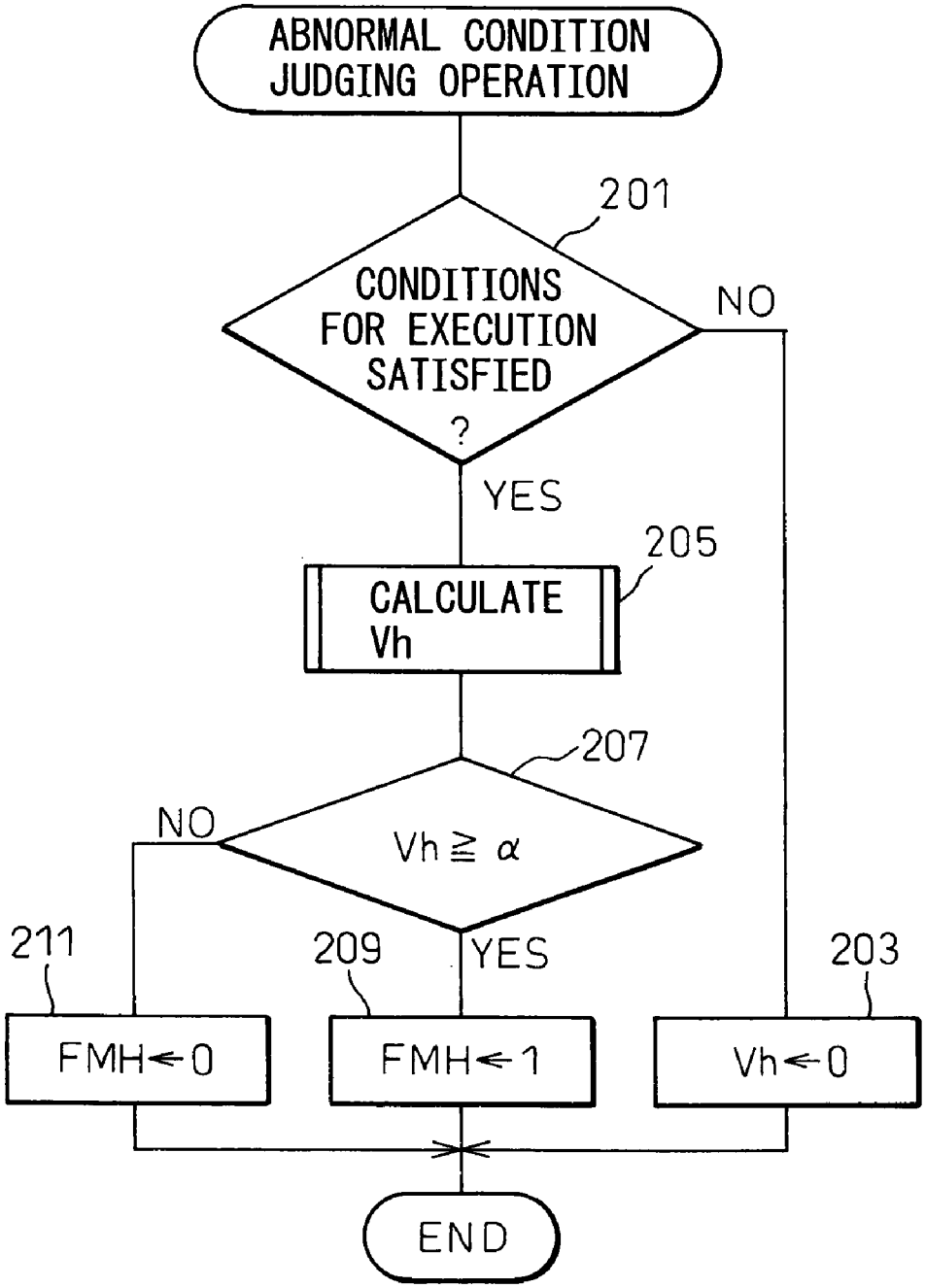
FIG. 2 is a flowchart illustrating the operation for judging the occurrence of an abnormal condition due to breakage of a separation membrane.

FIG. 2 is a flowchart illustrating the operation for judging the occurrence of an abnormal condition due to the breakage of the separation membrane according to the invention. This operation is performed, for example, as a routine executed at regular intervals by, the electronic control unit 30.

In the operation of FIG. 2, the occurrence of an abnormal condition due to the breakage of the separation membrane is judged based on the amount the high-octane fuel is formed.

In the operation of FIG. 2, it is judged, first, at step 201 whether the conditions for executing the judgment of the occurrence of an abnormal condition due to the breakage of the separation membrane are satisfied.

In this embodiment, it is judged that the conditions for executing the judgment are satisfied only when all of the following conditions are satisfied at step 201.

1) The liquid level control is executed by the electronic control unit 30 in such a manner that the liquid level of the high-octane fuel becomes constant in the vapor/liquid separator 130;

2) No abnormal condition is occurring in the flow rate control valve 1305 or in the level gauge 1303 of the vapor/liquid separator 130;

3) The amount of the material fuel in the material fuel tank 3 is not smaller than a predetermined value;

4) The level sensor 701 of the high-octane fuel tank 7 is not in an abnormal condition; and 5) The feed pressure of the material fuel to the separation membrane (the discharge pressure of the feed pump 31) is at a predetermined value.

These conditions will be described later in detail.

When the execution conditions are not satisfied at step 201, the operation proceeds to step 203 where a value of the high-octane fuel formation amount Vh that will be described below is set to 0 and the operation ends at this time.

When the execution conditions are satisfied at step 201, on the other hand, the operation proceeds to step 205 to calculate a high-octane fuel formation amount Vh.

In this case, the high-octane fuel formation amount Vh may be obtained by directly measuring the flow rate of the high-octane fuel flowing through the pipe 1301, for example, by disposing a flow rate sensor on the high-octane fuel pipe 1301. In this embodiment, however, the high-octane fuel formation amount Vh is calculated based on the amount of fuel in the high-octane fuel tank 7 and on the amount of the high-octane fuel fed to the engine 1.

Namely, in this embodiment, the electronic control unit 30 calculates a change (increment) V1 in the amount of fuel stored in the tank 7 from a change, within a predetermined period of time T, in the liquid level detected by the level sensor 701 in a state where the judgment execution conditions are satisfied at step 201, and detects the amount V2 of the high-octane fuel fed to the engine within the period of time T.

The amount of fuel flowing into the fuel tank 7 from the vapor/liquid separator 130 within the period of time T is equal to the sum of the change V1 in the amount of fuel in the fuel tank 7 and the amount of the fuel that flows out from the fuel tank 7 within the period of time T or the amount V2 of fuel fed to the engine 1 within the period of time T.

Therefore, the amount of the high-octane fuel that flows into the fuel tank 7 within a unit time, i.e., the amount Vh the high-octane fuel is formed, is calculated as Vh=(V1+V2)/T.

After the amount of the high-octane fuel Vh formed by the separation is calculated at step 205, it is judged at step 207 whether the amount of forming of the high-octane fuel Vh is larger than a predetermined upper limit value $\alpha$. The upper limit value is a value larger than a maximum value in a range of the amount of forming the high-octane fuel under the ordinary conditions, and varies depending upon the kind and size of the separation membrane. The actual value of $\alpha$, therefore, is set based upon the experimental results obtained by using the actual separation apparatus.

When $Vh \geqq \alpha$ at step 207, the high-octane fuel has been formed in amounts that could never be accomplished under the normal condition, and it can be judged that an abnormal condition is occurring in the separation membrane 1101, such as the formation of a hole or damage. In this case, next step 209 is executed after step 207, and the value of the flag FMH is set to 1 before the operation ends.

Further, when $Vh < \alpha$ at step 207, since the amount the high-octane fuel formed does not so increase as to be judged to be abnormal, the operation proceeds to step 211 and sets the value of the flag FMH to 0.

FMH is a flag indicating whether an abnormal condition is occurring such as breakage in the separation membrane and FMH=1 indicates that an abnormal condition is occurring and FMH=0 indicates that no abnormal condition is occurring.

In this embodiment, when the value of the flag FMH is set to 1, the operation separately executed by the electronic control unit 30 turns an alarm lamp (not shown) arranged near the driver's seat of the vehicle in order to inform the driver of the occurrence of an abnormal condition.

Figure 3:
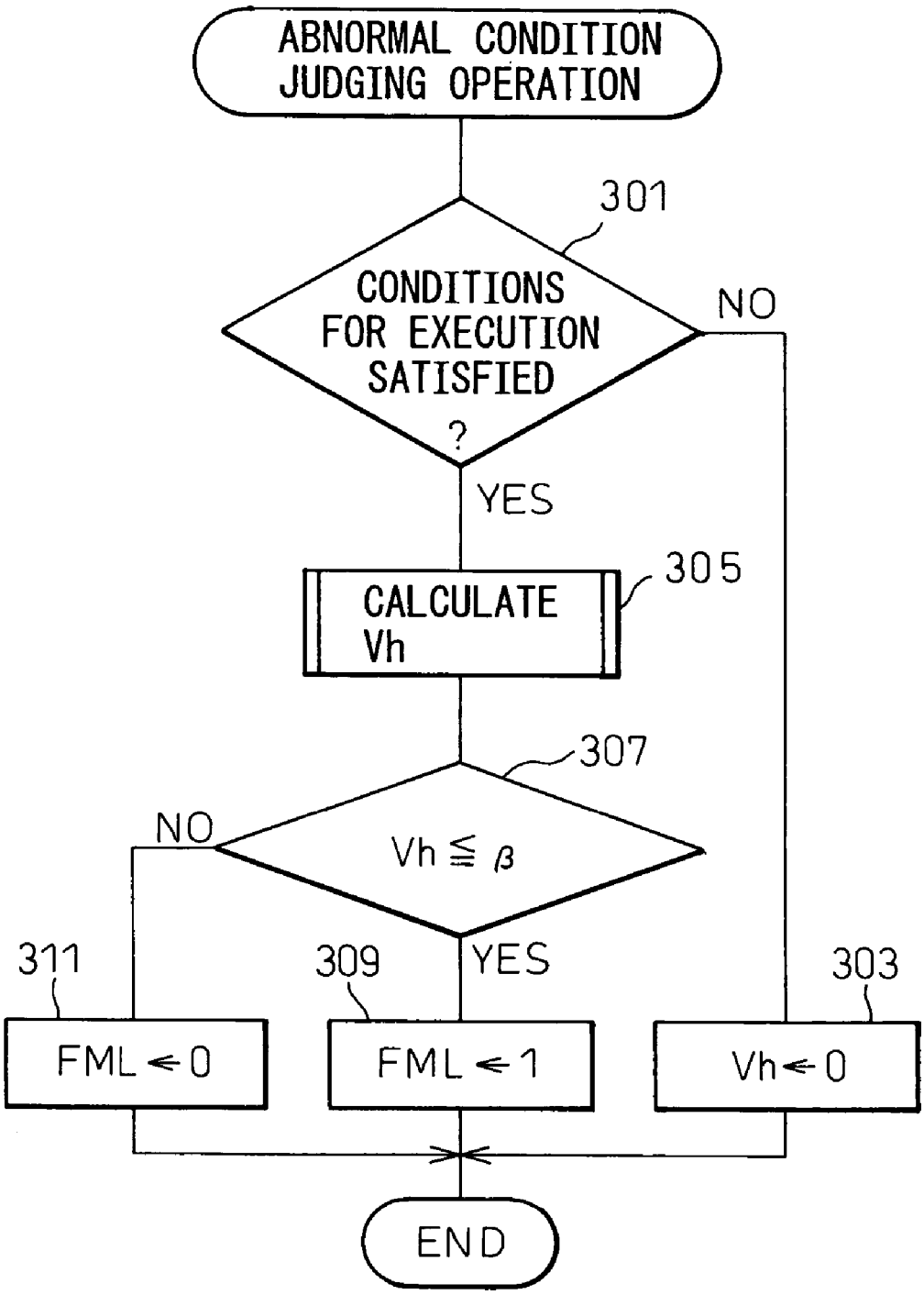
FIG. 3 is a flowchart illustrating the operation for judging the occurrence of an abnormal condition due to a drop in the function such as clogging or deterioration of the separation membrane.

Next, described below with reference to FIG. 3 is an operation for judging the occurrence of an abnormal condition due to a drop in the function such as clogging or deterioration of the separation membrane according to the embodiment. FIG. 3 is a flowchart illustrating the operation for judging the abnormal condition due to a drop in the function, which is performed, for example as a routine executed at regular intervals by the electronic control unit 30 like the operation of FIG. 2.

Like the operation of FIG. 2, the operation of FIG. 3 judges the occurrence of an abnormal condition due to a drop in the function of the separation membrane based on the amount the high-octane fuel formed.

The operations of steps 301 to 305 in FIG. 3 are the same as the operations of steps 201 to 205 in FIG. 2. Namely, in this embodiment, too, it is judged at step 301 whether the conditions for executing the judgment are satisfied. When the conditions are not satisfied, the value of the high-octane fuel formation amount Vh is set to zero and the operation ends immediately. When the conditions for executing the judgment are satisfied, the operation proceeds to step 305 to calculate the high-octane fuel forming amount Vh by the same operation as that of step 205.

At step 307, it is judged whether the calculated amount Vh that is smaller than a predetermined lower limit value $\beta$. The lower limit value $\beta$ is a value smaller than a minimum value in a range of forming the high-octane fuel under the normal condition. Like $\alpha$ of FIG. 2, the lower limit value $\beta$ is set by conducting an experiment by using the actual separation apparatus.

In this embodiment, when the high-octane fuel formation amount Vh is smaller than the lower limit value $\beta$, it is considered that the function of the separation membrane is dropping so that the amount of the high-octane fuel formed is decreasing down to a value that could not occur under the normal operating conditions. In this case, therefore, the value of the flag FML is set to 1 at step 309. When the amount Vh is larger than the lower limit value $\beta$ at step 307, it is considered that the function of the separation membrane is not dropping. Therefore, the value of the flag FML is set to 0 at step 311 before the operation ends.

FML is a flag indicating whether an abnormal condition is occurring due to a drop in the function of the separation membrane and FML=1 indicates that an abnormal condition is occurring, and FML=0 indicates that no abnormal condition is occurring.

In this embodiment, when the value of the flag FML is set to 1, the alarm lamp (not shown) arranged near the driver's seat of the vehicle is turned on as in the case of the flag FMH in order to inform the driver of the occurrence of an abnormal condition.

Next, the operation for executing the judgment in the operations of FIGS. 2 and 3 (step 201 in FIG. 2 and step 301 in FIG. 3) are explained.

At step 201 in FIG. 2 and at step 301 in FIG. 3, the following conditions are judged as conditions for executing the judging operation.

1) The liquid level control is executed by the electronic control unit 30 in such a manner that the liquid level of the high-octane fuel becomes constant in the vapor/liquid separator 130;

2) No abnormal condition is occurring in the flow rate control valve 1305 or in the level gauge 1303 of the vapor/liquid separator 130;

3) The amount of the material fuel in the material fuel tank 3 is not smaller than a predetermined value;

4) The level sensor 701 of the high-octane fuel tank 7 is not in an abnormal condition; and 5) The feed pressure of the material fuel to the separation membrane (the discharge pressure of the feed pump 31) is at a predetermined value.

The above conditions 1) and 2) are for ensuring that the amount of the high-octane fuel separated by the separation membrane 1101 and flowing into the vapor/liquid separator 130 is equal to the amount of the high-octane fuel flowing out from the vapor/liquid separator 130 and flowing into the fuel tank 7, so that a change in the liquid level in the tank 7 correctly reflects the amount of the high-octane fuel formed by the separation. Therefore, it is preferable that any abnormal condition in the flow rate control valve 1305 and in the level gauge 1303 has been judged in advance by a method described later prior to executing the judging operation of FIGS. 2 and 3.

The above condition 3) in this embodiment is for measuring a change in the liquid level in the fuel tank within a predetermined period of time T for calculating the amount the fuel separated. That is, if the material fuel in the material fuel tank 3 is all consumed within the measuring period of time T, it is not possible to correctly calculate the amount the high-octane fuel formed by the separation. In this embodiment, therefore, the judging operation of FIGS. 2 and 3 is executed only when the material fuel is stored in the material fuel tank 3 in an amount larger than a predetermined amount, i.e., in an amount large enough for feeding the fuel to the fuel separation apparatus 10 for at least the period of time T.

In this embodiment, further, the above condition 4) is for correctly measuring the liquid level in the fuel tank 7 for calculating the amount of the high-octane fuel formed by the separation based on a change in the liquid level in the high-octane fuel tank 7 and on the amount the high-octane fuel fed to the engine 1.

The condition 5) is for maintaining the amount of the high-octane fuel formed by the separation to be as constant as possible during the execution of the judgment because the amount of the high-octane fuel formed by the separation may vary depending upon the feeding pressure of the material fuel despite other conditions remain the same.

In the operations of FIGS. 2 and 3, the operation for judging an abnormal condition due to the breakage of the separation membrane and the operation for judging an abnormal condition due to a drop in the function are executed as separate operations. However, the two judgment operations may be executed in a single operation, as a matter of course.

In FIGS. 2 and 3, further, the amount of the high-octane fuel formed is calculated based on a change in the liquid level in the fuel tank 7 and on the amount of the high-octane fuel fed to the engine. Instead of relying upon the change in the liquid level in the fuel tank 7, however, the amount of the high-octane fuel formed may be calculated from a change in the liquid level of the high-octane fuel in the vapor/liquid separator 130 when the high-octane fuel flow rate control valve 1305 is maintained at the fully closed position by interrupting the liquid level control in the vapor/liquid separator 130 in case where only the occurrence of an abnormal condition, for example, in the separation membrane is to be judged. In this case, the amount of the high-octane fuel formed by the separation can be calculated from a change in the liquid level in the vapor/liquid separator 130 without taking into consideration the amount of the fuel fed to the internal combustion engine 1.

In the operations of FIGS. 2 and 3, an abnormal condition in the separation membrane is judged based on the amount of the high-octane fuel formed by the separation. As described above, however, if the separation membrane becomes abnormal, the amount of the low-octane fuel formed by the separation changes in a direction opposite to the amount of the high-octane fuel formed by the separation. Therefore, the occurrence of an abnormal condition in the separation membrane may be judged based upon the amount of the low-octane fuel formed by the separation (e.g., based on a change in the liquid level in the low-octane fuel tank and on the amount of the low-octane fuel fed to the engine 1) instead of the amount of the high-octane fuel formed by the separation.

In the operations of FIGS. 2 and 3, further, the occurrence of an abnormal condition in the separation membrane is judged based on the result of measuring a change in the liquid level in the fuel tank 7. However, the separation apparatus 10 of this embodiment is mounted on a vehicle. Therefore, if it is attempted to judge any abnormal condition while the vehicle is traveling, the amount of the high-octane fuel formed by the separation may be incorrectly calculated due to a variation in the liquid level in the fuel tank 7 caused by the movement of the vehicle.

Therefore, the operations of FIGS. 2 and 3 may be executed only when the vehicle is halted (when the engine is idling or when the vehicle is traveling at a speed lower than a predetermined value) where the liquid level in the tank remains stable.

(2) Abnormal condition in the flow rate control system.

If an abnormal condition occurs in the flow rate control system (e.g., in the high-octane fuel flow rate control valve 1305, level gauge 1303 of the vapor/liquid separator, low-octane fuel flow rate control valve 1115) of the separation apparatus, the amount and the octane value of the separated fuels undergo changes.

As described earlier, further, if an abnormal condition occurs in the flow rate control system, the occurrence of an abnormal condition in the separation membrane 1101 cannot be correctly judged.

In this embodiment, therefore, whether an abnormal condition is occurring in the flow rate control system of the separation apparatus 10 is judged by a method described below.

Figure 4:
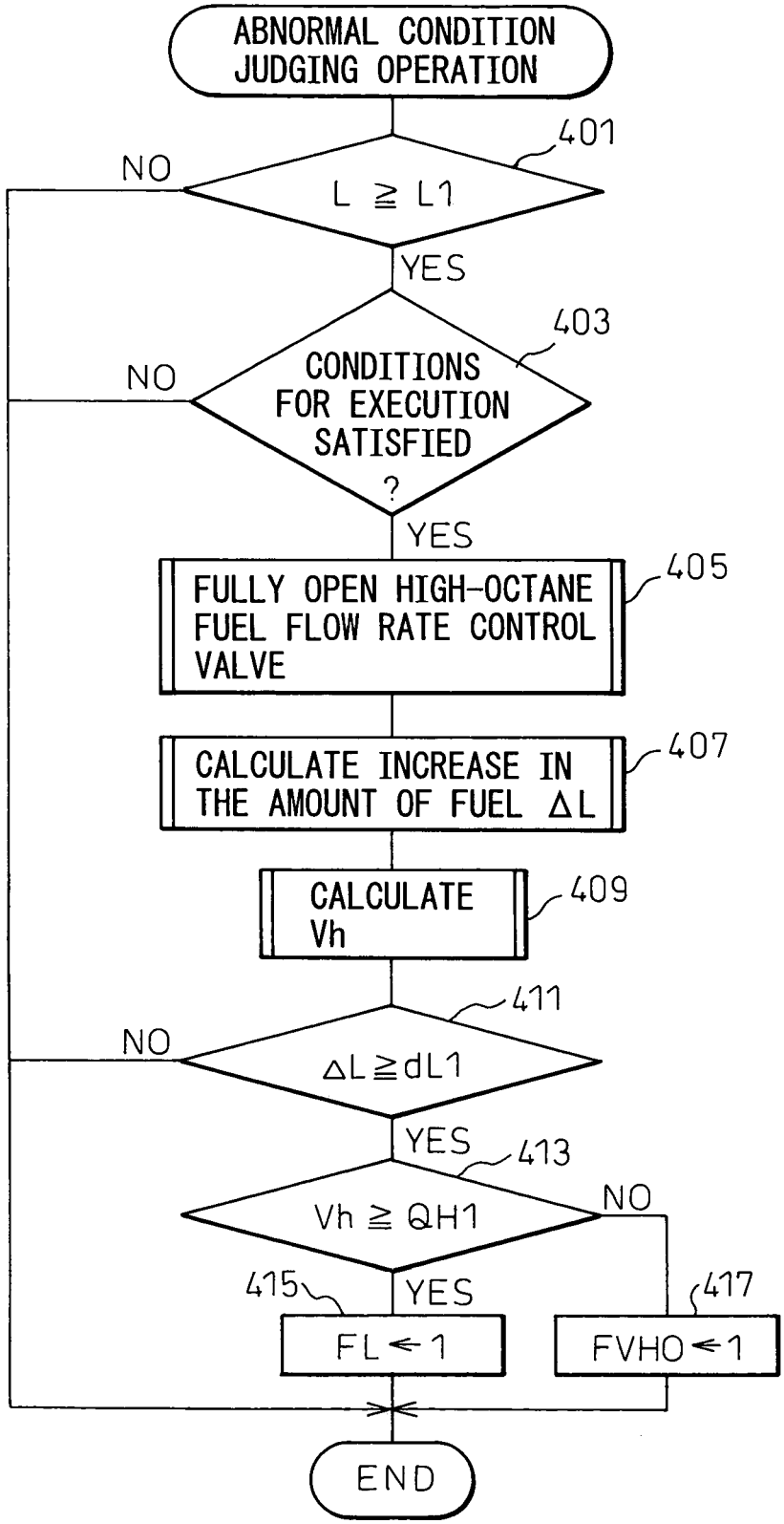
FIG. 4 is a flowchart illustrating the operation for judging the occurrence of an abnormal condition in a high-octane fuel flow rate control valve and in a level gauge of the vapor/liquid separator.
Figure 5:
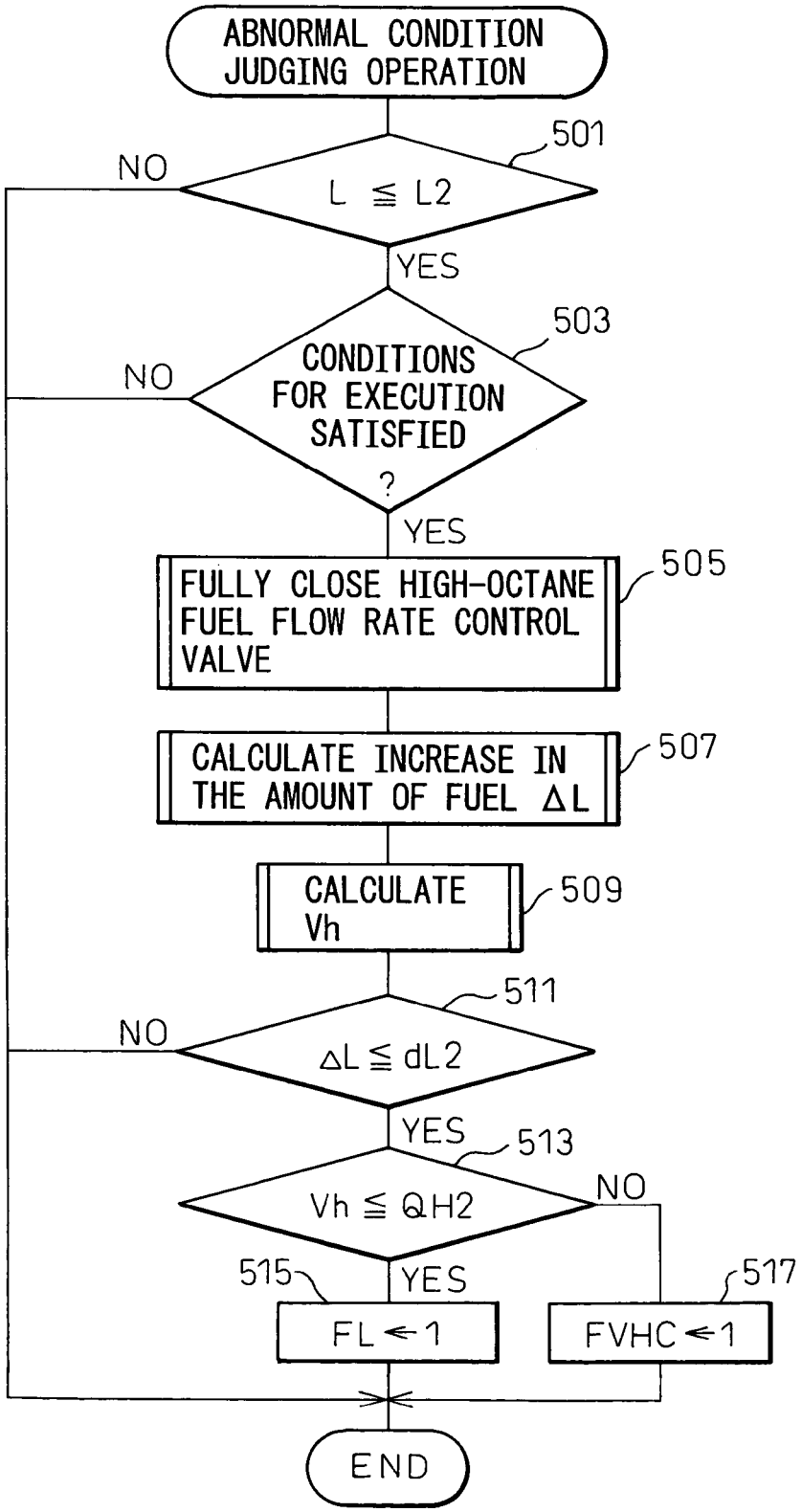
FIG. 5 is a flowchart illustrating the operation for judging the occurrence of an abnormal condition in the high-octane fuel flow rate control valve and in the level gauge of the vapor/liquid separator.

FIGS. 4 and 5 are flowcharts illustrating the operations for judging the occurrence of an abnormal condition in the high-octane fuel flow rate control valve 1035 and in the level gauge 1303 of the vapor/liquid separator, FIG. 4 illustrating the operation for judging the abnormal opening (locked closed) of the control valve 1305 and an abnormal condition (locking) of the level gauge 1303, and FIG. 5 illustrating the operation for judging the abnormal closing (locked opened) of the control valve 1305 and an abnormal condition (locking) of the level gauge 1303.

In the operation of FIG. 4, the high-octane fuel flow rate control valve 1035 is maintained in the fully opened position for a predetermined period of time while the separation apparatus is in operation and, during this period, the amount ΔL of change in the liquid level in the vapor/liquid separator 130 detected by the level gauge 1303 and the amount Vh of fuel flowing into the high-octane fuel tank 7 are compared with predetermined values, respectively, to judge whether any abnormal condition in the control valve 1305 and in the level gauge 1303 exists.

The operation of FIG. 4 is executed as a routine at regular intervals by the electronic control unit 30.

In the operation of FIG. 4, it is judged at step 401, first, if the liquid level L in the vapor/liquid separator 130 is higher than the predetermined value L1. In this embodiment as will be described later, the flow rate control valve 1035 must be maintained fully opened for a predetermined period of time while the judging operation is being carried out. In this period, the amount of the high-octane fuel in the vapor/liquid separator 130 flowing into the tank 7 increases. To prevent the separator 130 from becoming empty in this period, a certain amount of the fuel must be retained in the separator 130. In practice, the above predetermined value L1 varies depending upon the volume of the vapor/liquid separator 130 and should, hence, be determined by conducting experiment by using an actual separator 10.

When the liquid level in the vapor/liquid separator 130 is higher than L1 at step 401, it is judged at next step 403 if the conditions for executing the judging operation are satisfied. The conditions for execution at step 403 are the same as the conditions judged at step 201 of FIG. 2 and at step 301 of FIG. 3.

When the conditions are all satisfied at step 403, the operation proceeds to step 405 where the high-octane fuel flow rate control valve 1305 is maintained fully opened for a predetermined period of time.

At steps 407 and 409, the operation is executed to calculate a rate of increase ΔL of the amount of the high-octane fuel (liquid level) in the vapor/liquid separator 130 within the above period of time and a flow rate Vh of the high-octane fuel flowing into the fuel tank 7. The liquid level ΔL is obtained from the output of the level gauge 1303, and the flow rate Vh is obtained from the output of the level gauge 701 and the amount of the high-octane fuel consumed by the engine 1, by the method described at step 205 in FIG. 2.

After ΔL and Vh are calculated, it is judged at step 411 if the rate of increase in the amount of fuel in the vapor/liquid separator 130 is larger than a predetermined value dL1 which is a relatively small negative value.

In this state, as the flow rate control valve 1305 is maintained fully opened, the rate of increase ΔL of the amount of fuel in the vapor/liquid separator 130 will decrease as compared to the case where the control operation is being executed for maintaining the liquid level constant in the vapor/liquid separator 130. Therefore, when ΔL is larger than dL1 at step 411 (i.e., when the liquid level of fuel in the vapor/liquid separator 130 is not decreasing even in a state where the control valve 1305 is fully opened), it is probable that some abnormal condition is occurring in the flow rate control system.

Namely, in this case, the flow rate control valve 1305 has not been fully opened despite receiving a full open instruction signal from the electronic control unit 30, or the flow rate control valve 1305 is fully opened and the liquid level is actually decreasing in the vapor/liquid separator 130 but the level gauge 1303 is not producing a signal corresponding to a decrease in the liquid level.

At step 413, therefore, it is judged which one of the two cases stated above is occurring based on the flow rate Vh of the high-octane fuel actually flowing into the fuel tank 7.

Namely, at step 413, it is judged if the flow rate Vh of fuel flowing into the fuel tank 7 is larger than a predetermined value QH1. The value QH1 is slightly smaller than the flow rate of fuel flowing into the fuel tank 7 from the vapor/liquid separator 130 when, for example, the control valve 1305 is fully opened under the normal operating conditions, and is precisely set by conducting an experiment using the actual separation apparatus 10.

If Vh is larger than the predetermined value QH1 at step 413, it means that the fuel is actually flowing into the tank at a full-open flow rate through the control valve 1305. In this case, therefore, it can be considered that the liquid level in the vapor/liquid separator 130 as detected by the level gauge 1303 is not decreasing because the level gauge 1303 itself is becoming abnormal.

In this case, therefore, the operation proceeds to step 415 where the value of the flag FL representing the abnormal condition in the level gauge 1303 is set to 1 (sensor is abnormal) before ending the operation.

On the other hand, when Vh is smaller than the predetermined value QH1 at step 413, it means that the flow rate of the fuel passing through the control valve 1305 is smaller than the full open flow rate despite the control valve 1305 is fully opened. In this case, therefore, it is probable that the high-octane fuel flow rate control valve 1305 is not opened (locked closed).

In this case, therefore, the operation proceeds to step 417 where the value of the flag FVHO is set to 1 (defective valve opening) to indicate the defective opening of the control valve 1305, and the operation ends.

In this embodiment, too, when the value of the flag FL is set to 1 (occurrence of an abnormal condition in the level gauge 1303) or when the value of the flag FVHO is set to 1 (flow rate control valve 1305 is abnormally opened), the alarm lamp near the driver's seat is turned on to inform the driver of the occurrence of an abnormal condition.

FIG. 5 illustrates a similar operation as that of FIG. 4. However, although the operation of FIG. 4 judges abnormal opening (locked closed) of the flow rate control valve 1305, the operation of FIG. 5 judges abnormal closing (locked opened) of the control valve 1305.

In the operation of FIG. 5, the control valve 1305 is maintained closed for a predetermined period of time while the separation apparatus is in operation, and an increase in the amount of fuel in the vapor/liquid separator 130 during this period of time and the amount of fuel flowing into the fuel tank 7 are compared with judging values, respectively.

That is, in the operation of FIG. 5, it is judged at step 501 whether the liquid level in the vapor/liquid separator 130 is lower than a predetermined relatively small value L2. In this embodiment, the control valve 1305 is maintained fully closed for a predetermined period of time during the judging operation. Therefore, the liquid level rises in the vapor/liquid separator 130 due to the high-octane fuel formed by the separation membrane 1101 and flowing into the vapor/liquid separator 130. It is, therefore, necessary that the liquid level at the start of the judging operation is low so as to permit an increase in the liquid level during the judging period. At the start of the judging operation, therefore, the liquid level must be lower than the relatively small value L2.

At step 503, it is judged whether the conditions for executing the judging operation, the same as those of step 403 of FIG. 4, are satisfied. When the conditions are all satisfied at step 503, the high-octane fuel flow rate control valve 1305 is held at fully closed position for a predetermined period of time at step 505. At steps 507 and 509, the rate of an increase ΔL in the amount of the high-octane fuel in the vapor/liquid separator 130 and the flow rate Vh of the high-octane fuel flowing into the fuel tank within the above period of time are calculated. The operations of steps 507 and 509 are the same as the operations of steps 407 and 409 of FIG. 4.

After ΔL and Vh are calculated, it is judged at step 511 whether the value ΔL is smaller than a predetermined value dL2 which is smaller than the rate of forming of the high-octane fuel under the normal state. In the operation of FIG. 5, the control valve 1305 is maintained fully closed and, hence, the amount of fuel stored in the vapor/liquid separator 130 increases in a normal condition, and ΔL will become a relatively large positive value. Therefore, when the value ΔL is smaller than dL2 at step 511, it is probable that the flow rate control valve 1305 is not fully closed despite receiving a full close command signal from the electronic control unit 30 or, alternatively, the output signal of the level gauge 1303 does not represent an increase in the liquid level in the vapor/liquid separator 130 despite the liquid level actually rising in the vapor/liquid separator 130.

In this case, therefore, the operation proceeds to step 513 to judge whether the flow rate Vh of the fuel flowing into the fuel tank 7 is smaller than the predetermined value QH2 which is a relatively small positive value.

When the flow rate Vh is smaller than QH2 at step 513, it is considered that the fuel does not flow into the fuel tank 7 through the control valve 1305. Therefore, it can be judged that the control valve 1305 has been closed in response to a full close instruction of the electronic control unit 30, and that the liquid level has been raised in the vapor/liquid separator 130. In this case, therefore, the operation proceeds to step 515 where the value of the flag FL is set to 1 to indicate the occurrence of an abnormal condition in the level gauge 1303.

When Vh is larger than QH2 at step 513, on the other hand, it means that the fuel is flowing into the tank 7 through the control valve 1305 that is supposed to have been fully closed. In this case, therefore, it is considered that the flow rate control valve 1305 has not actually been fully closed, i.e., the control valve 1305 is in abnormal condition (locked opened).

In this case, therefore, the value of the flag FVHC representing the abnormal closure of the control valve 1305 is set to 1 (occurrence of abnormal valve closure) to end the operation.

In the operation of FIG. 5, too, if either the flag FL or the flag FVHC is set to 1, the alarm lamp near the driver's seat is turned on to inform the driver of the occurrence of an abnormal condition.

Figure 6:
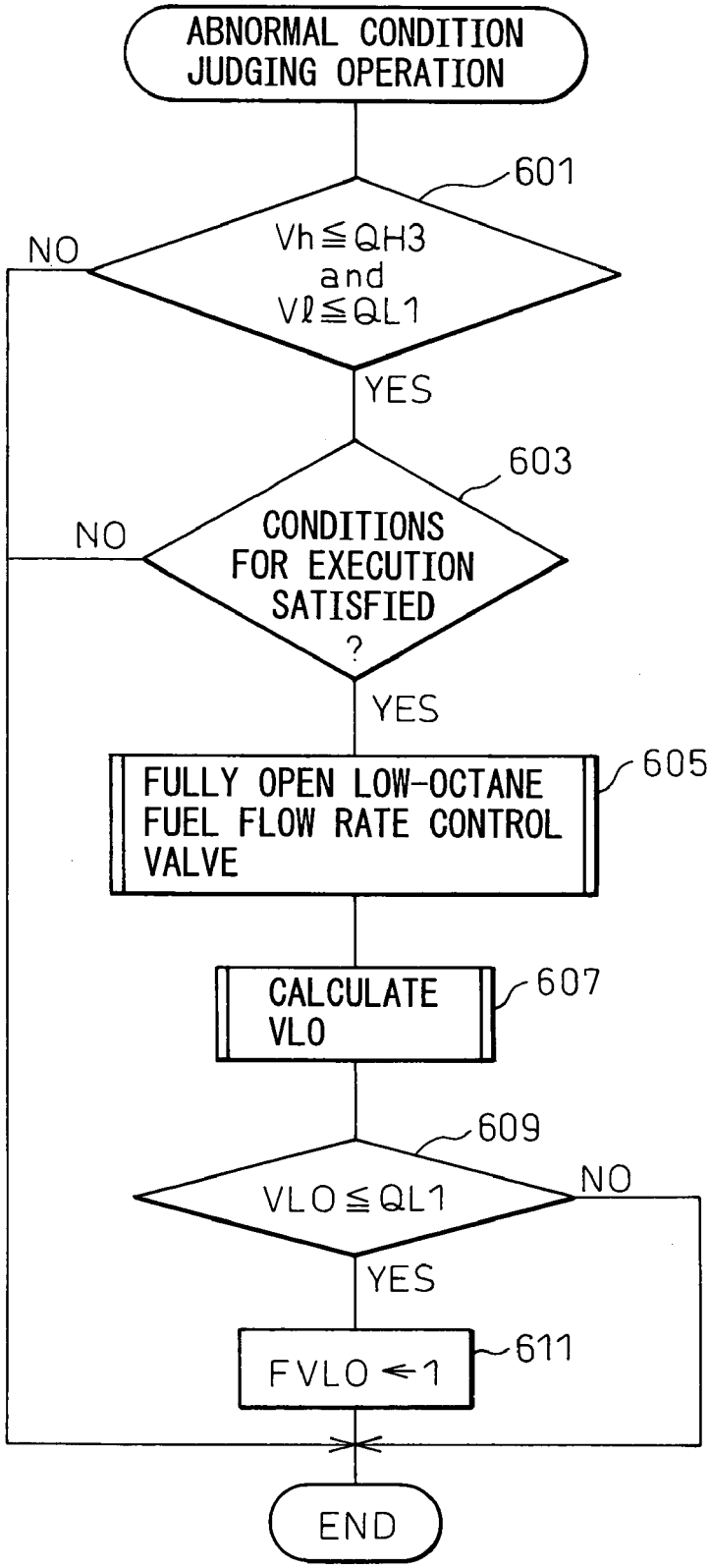
FIG. 6 is a flowchart illustrating the operation for judging the occurrence of an abnormal condition in a low-octane fuel flow rate control valve.
Figure 7:
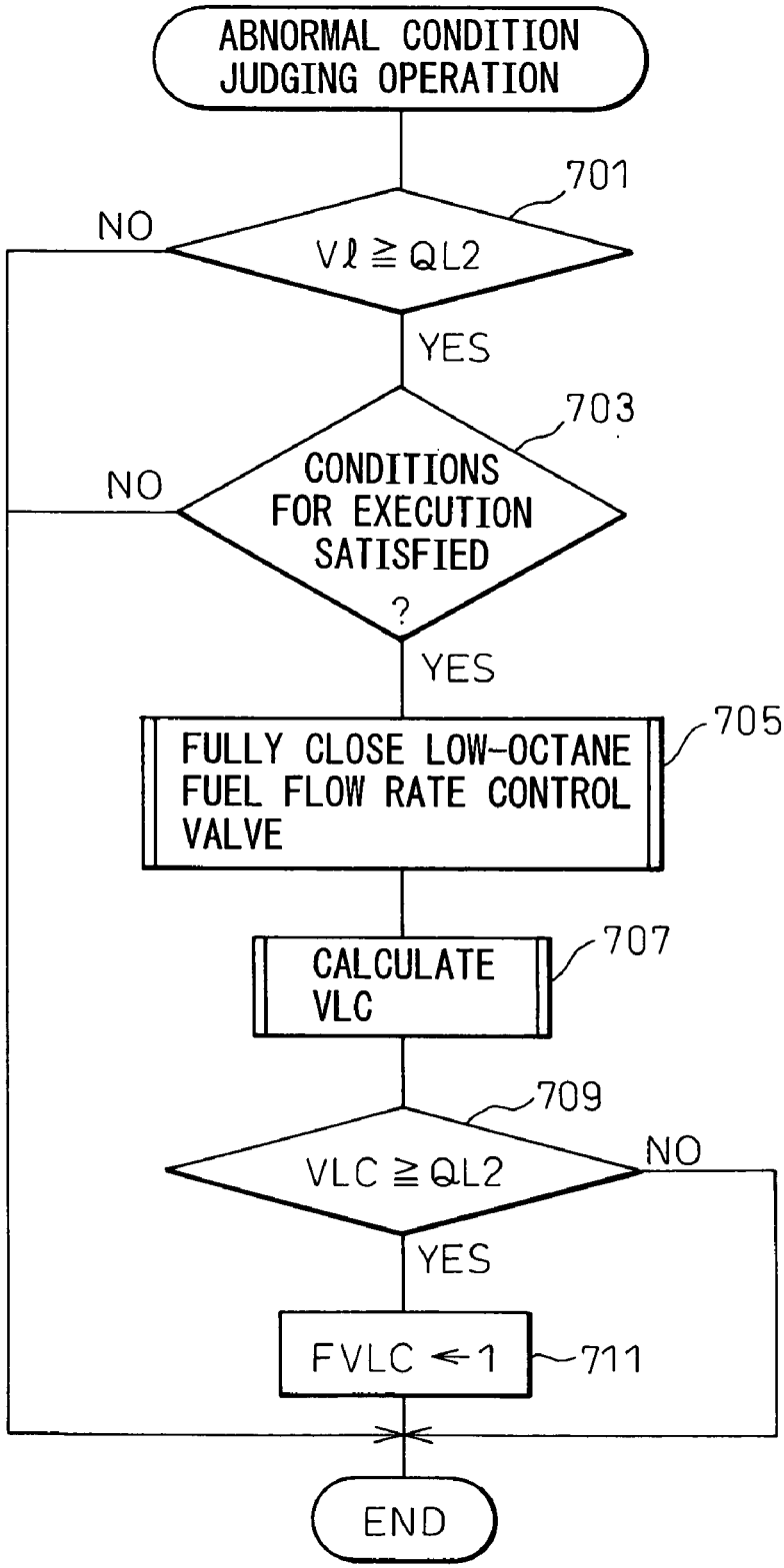
FIG. 7 is a flowchart illustrating the operation for judging the occurrence of an abnormal condition in the low-octane fuel flow rate control valve.

Next, described below with reference to FIGS. 6 and 7 are the operations for judging an abnormal condition in the low-octane fuel flow rate control valve 1115.

FIG. 6 is a flowchart illustrating the operation for judging defective opening of the low-octane fuel flow rate control valve 1115, and FIG. 7 is a flowchart illustrating the operation for judging defective closure thereof.

These operations, too, are executed as routines at regular intervals by the electronic control unit 30.

In the operation of FIG. 6, when the flow rate of the fuel passing through the low-octane fuel flow rate control valve 1115 (flow rate of the low-octane fuel flowing into the low-octane fuel tank 5) is smaller than a predetermined value while the separation apparatus 10 is in operation, the flow rate control valve 1115 is maintained fully opened and the flow rate of the fuel passing through the low-octane fuel flow rate control valve 1115 is calculated. When the flow rate of the fuel passing through the flow rate control valve 1115 is smaller than the above predetermined value despite of the fully opened state thereof, it is so judged that the flow rate control valve 1115 has failed (is locked closed).

That is, in FIG. 6, at step 601, the operation calculates fuel flow rates (flow rates of fuel passing through the flow rate control valves 1305 and 1115) Vh and Vl that are flowing into the high-octane fuel tank 7 and into the low-octane fuel tank 5, respectively, and judges whether Vh and V1 are smaller than the predetermined values QH3 and QL1. When both Vh≦QH3 and V1≦QL1 are satisfied, the operation proceeds to step 603 and judges whether the present conditions are satisfied for executing the judging operation.

The flow rate Vh is calculated by dividing, by the time T, the sum of the increment of the fuel in the high-octane fuel tank 7 and the amount of the high-octane fuel fed to the engine 1 during the predetermined period of time T as described earlier. The flow rate V1 is calculated by dividing, by the time T, the sum of the increment of the fuel in the low-octane fuel tank 5 and the amount of the low-octane fuel fed to the engine 1 during the predetermined period of time T.

In this embodiment, the conditions for executing the judging operation at step 603 are the same as those of step 403 in FIG. 4 and step 503 in FIG. 5.

When the conditions are all satisfied at step 603, the operation proceeds to step 605 where the low-octane fuel flow rate control valve 1115 is maintained fully opened. At step 607, the amount VLO of fuel passing through the flow rate control valve 1115 in a state where the control valve 1115 is maintained fully opened is calculated by the same method as that explained at step 601.

At step 609, it is judged again whether the flow rate VLO calculated at step 609 is smaller than the above judging value QL1. In a state where the control valve 1115 is fully opened, the flow rate becomes larger than that of before the control valve 1115 was fully opened provided the control valve 1115 is not becoming abnormal.

Therefore, when the flow rate of the fuel passing through the control valve is still smaller than QL1 despite the control valve 1115 is fully opened at step 609, it can be so judged that the flow rate control valve 1115 has not actually been fully opened or the control valve 1115 has been abnormally opened due to the locking of the valve body.

In this case, the value of the flag FVLO representing the abnormal opening of the low-octane fuel flow rate control valve 1115 is set at step 611 to 1 (occurrence of abnormal valve opening).

In this embodiment, too, if the value of the flag FVLO is set to 1 (abnormal valve closure), the alarm lamp arranged near the driver's seat is turned on to inform the driver of the occurrence of an abnormal condition.

FIG. 7 is a flowchart illustrating the operation for judging abnormal closure of the low-octane fuel flow rate control valve 1115. This operation, too, is executed as the routine at regular intervals by the electronic control unit 30.

In the operation of FIG. 7, when the flow rate of fuel passing through the control valve 1115 is larger than the predetermined value while the separation apparatus 10 is in operation, the control valve 1115 is fully closed and the flow rate is calculated again in this state. When the flow rate is still larger than the predetermined value, it is judged that the control valve 1115 is defectively closed.

Namely, at step 701 in FIG. 7, the flow rate of fuel now passing through the control valve 1115 (flow rate of the low-octane fuel flowing into the fuel tank 5) is calculated by a similar operation as that of FIG. 6 in order to judge whether V1 is larger than the predetermined value QL2.

When V1≧QL2 at step 701, the operation proceeds to step 703 to judge whether the conditions are satisfied for executing the judging operation. The conditions of step 703 are the same as the conditions of step 603 in FIG. 6.

When the executing conditions are satisfied at step 703, the control valve 1115 is fully closed at step 705. At step 707, the flow rate VLC through the control valve 1115 is calculated in a state where the control valve 1115 is fully closed. At step 709, it is judged whether the flow rate VLC that is calculated with the control valve being fully closed is larger than the above predetermined value QL2.

When the flow rate VLC through the control valve 1115 is larger than the above predetermined value QL2, it means that the fuel is still flowing in large amounts through the control valve 1115 despite the control valve 1115 being fully closed. In practice, therefore, it is so judged that the control valve 1115 is abnormally closed (locked open).

In this case, therefore, the value of the flag FVLC representing the abnormal closure of the flow rate control valve 1115 is set to 1 (occurrence of abnormal closure) at step 711. In this embodiment, too, the alarm lamp near the driver's seat is turned on when the value of the flag FVLC is set to 1 like in the case of FIG. 6.

In the foregoing was described the operations for judging abnormal conditions in various portions of the separation apparatus 10 by using FIGS. 2 to 7. If an abnormal condition occurs in the separation apparatus 10, it is desired to readily stop the separation apparatus 10 to repair a portion where the abnormal condition has occurred. In practice, however, when the operation of the separation apparatus 10 is aborted, it becomes necessary to continue to drive the vehicle using only the fuels stored in the tanks 5 and 7 of separated fuels. When the amounts of fuels in the tanks are not sufficient, therefore, it may happen that the vehicle cannot travel by itself to a repair shop.

Therefore, when the operation of the separation apparatus 10 must be stopped due to abnormal conditions thereof, the material fuel tank 3 may be directly connected to the fuel injection system of the engine 1 so that the material fuel is directly fed to the engine 1 from the fuel tank 3. In this case, however, it becomes necessary to provide an emergency fuel pipe and a changeover valve for directly connecting the material fuel tank 3 to the engine 1, causing the apparatus to become complex.

This embodiment solves the above-mentioned problems without the need of newly providing an emergency fuel pipe or a changeover valve, and makes it possible to feed the material fuel to the engine 1 in case any abnormal condition is detected in the separation apparatus.

Namely, in this embodiment, if any abnormal condition is detected in the separation apparatus 10 by the operations of, for example, FIGS. 2 to 7, most of the material fuel in the fuel tank 3 is transferred to the low-octane fuel tank 5. The fuel is transferred without using any separate pipe but by simply maintaining the flow rate control valve 1115 in the fully opened state on the side of the low-octane fuel. This causes an increase in the flow rate of the fuel flowing into the low-octane fuel tank 5 passing through the flow rate control valve 1115, and the pressure in the high-pressure section (section on the side of the low-octane fuel) 1103 in the separation membrane module 1100 drops. In the high-pressure section 1103, therefore, the residence time of the material fuel is largely shortened, the pressure in the section, too, drops largely, and the amount of fuel flows into the side of the low-pressure section through the separation membrane 1101 decreases.

Therefore, the material fuel in the fuel tank 3 quickly moves into the low-octane fuel tank 5 and, as the fuel passing through the separation membrane 1101 decreases, the separated fuel having an insufficiently low octane value is prevented from flowing into the fuel tank 7. Therefore, a decrease in the fuel octane value that results from the dilution of the high-octane fuel in the tank 7 does not occur.

What is claimed is:

1. An onboard fuel separation apparatus provided with a separation membrane which separates a fuel supplied as a material fuel into a high-octane fuel containing fractions of high octane values in amounts larger than that of the material fuel and a low-octane fuel containing fractions of low octane values in amounts larger than that of the material fuel, comprising abnormal condition-judging means for judging whether an abnormal condition is occurring in the fuel separation apparatus based upon the rate of forming of at least either the high-octane fuel or the low-octane fuel after the separation.

2. An onboard fuel separation apparatus according to claim 1, wherein the separation membrane permits the selective passage of aromatic fractions in the material fuel fed to one side of the separation membrane, and forms the high-octane fuel on the other side of the separation membrane, and the abnormal condition-judging means so judges that an abnormal condition is occurring in the fuel separation apparatus due to the breakage of the separation membrane when the rate of forming the high-octane fuel after the separation is larger than a predetermined upper limit value.

3. An onboard fuel separation apparatus according to claim 1, wherein the separation membrane permits the selective passage of aromatic fractions in the material fuel fed to one side of the separation membrane, and forms the high-octane fuel on the other side of the separation membrane, and the abnormal condition-judging means so judges that an abnormal condition is occurring in the fuel separation apparatus, due to a drop in the function of the separation membrane, when the rate of forming the high-octane fuel after the separation is smaller than a predetermined lower limit value.

4. An onboard fuel separation apparatus according to claim 2, wherein the abnormal condition-judging means further judges that an abnormal condition is occurring in the fuel separation apparatus due to a drop in the function of the separation membrane when the rate of forming the high-octane fuel after the separation is smaller than a predetermined lower limit value which is smaller than the upper limit value.

5. An onboard fuel separation apparatus according to claim 1, further comprising a separated fuel tank for storing at least one the high-octane fuel or the low-octane fuel separated by the separation membrane, a separated fuel passage for flowing said one of the fuels separated by the separation membrane into the separated fuel tank, and flow rate-adjusting means for controlling the flow rate of the separated fuel flowing through the separated fuel passage at a target control flow rate, wherein the abnormal condition-judging means judges whether an abnormal condition is occurring in the flow rate-adjusting means based on the target control flow rate of the flow rate-adjusting means and on an actual separated fuel flow rate flowing through the separated fuel passage.

6. An onboard fuel separation apparatus according to claim 5, wherein the abnormal condition-judging means calculates the actual separated fuel flow rate flowing through the separated fuel passage based on the amount of the separated fuel in the separated fuel tank and on the amount of fuel fed to the internal combustion engine from the separated fuel tank.

7. An onboard fuel separation apparatus according to claim 5, further comprising a separated fuel reservoir, for storing the separated fuel, being arranged between the separation membrane and the flow rate-adjusting means, stored fuel amount detector means for detecting the amount of the separated fuel stored in the separated fuel reservoir, and flow rate control means for controlling the target control flow rate of the flow rate-adjusting means so that the stored amount detected by the stored fuel amount detector means becomes a preset value, wherein the abnormal condition-judging means judges whether an abnormal condition is occurring in the stored fuel amount detector means based on the target control flow rate of the flow rate control means, on an actual separated fuel flow rate flowing through the separated fuel passage and on a separated fuel amount detected by the stored fuel amount detector means.

8. An onboard fuel separation apparatus according to claim 5, further comprising a separated fuel tank for storing at least the high-octane fuel, wherein the separation membrane permits the selective passage of aromatic fractions in the material fuel fed to one side of the separation membrane, and forms the high-octane fuel on the other side of the separation membrane, and the abnormal condition-judging means so judges that an abnormal condition is occurring in the fuel separation apparatus due to the breakage of the separation membrane when it has been so judged that no abnormal condition is occurring in the flow rate-adjusting means and when the rate of forming the high-octane fuel after the separation is larger than a predetermined upper limit value.

9. An onboard fuel separation apparatus according to claim 5, having the separated fuel tank for storing at least the high-octane fuel, wherein the separation membrane permits the selective passage of aromatic fractions in the material fuel fed to one side of the separation membrane, and forms the high-octane fuel on the other side of the separation membrane, and the abnormal condition-judging means so judges that an abnormal condition is occurring in the fuel separation apparatus due to a drop in the function of the separation membrane when it has been so judged that no abnormal condition is occurring in the flow rate-adjusting means and when the rate of forming the high-octane fuel after the separation is smaller than a predetermined lower limit value.

10. An onboard fuel separation apparatus according to claim 8, wherein the abnormal condition-judging means so judges that an abnormal condition is occurring in the fuel separation apparatus due to a drop in the function of the separation membrane when the rate of forming the high-octane fuel after the separation is smaller than a predetermined lower limit value which is smaller than the upper limit value.

11. An onboard fuel separation apparatus according to claim 1 further comprising the material fuel tank for storing the material fuel, wherein the abnormal condition-judging means judges whether an abnormal condition is occurring when the amount of the material fuel in the material fuel tank is larger than a predetermined lower limit value for executing the judgment of abnormal condition.

12. An onboard fuel separation apparatus according to claims 1 further comprising the material fuel tank for storing the material fuel and a low-octane fuel tank for storing the low-octane fuel after the separation, wherein when it is judged, by the abnormal condition-judging means, that an abnormal condition is occurring, the material fuel in the material fuel tank is transferred into the low-octane fuel tank.

13. An onboard fuel separation apparatus according to claim 6, further comprising a separated fuel reservoir, for storing the separated fuel, being arranged between the separation membrane and the flow rate-adjusting means, stored fuel amount detector means for detecting the amount of the separated fuel stored in the separated fuel reservoir, and flow rate control means for controlling the target control flow rate of the flow rate-adjusting means so that the stored amount detected by the stored fuel amount detector means becomes a preset value, wherein the abnormal condition-judging means judges whether an abnormal condition is occurring in the stored fuel amount detector means based on the target control flow rate of the flow rate control means, on an actual separated fuel flow rate flowing through the separated fuel passage and on a separated fuel amount detected by the stored fuel amount detector means.

14. An onboard fuel separation apparatus according to claim 6, further comprising a separated fuel tank for storing at least the high-octane fuel, wherein the separation membrane permits the selective passage of aromatic fractions in the material fuel fed to one side of the separation membrane, and forms the high-octane fuel on the other side of the separation membrane, and the abnormal condition-judging means so judges that an abnormal condition is occurring in the fuel separation apparatus due to the breakage of the separation membrane when it has been so judged that no abnormal condition is occurring in the flow rate-adjusting means and when the rate of forming the high-octane fuel after the separation is larger than a predetermined upper limit value.

15. An onboard fuel separation apparatus according to claim 6, having the separated fuel tank for storing at least the high-octane fuel, wherein the separation membrane permits the selective passage of aromatic fractions in the material fuel fed to one side of the separation membrane, and forms the high-octane fuel on the other side of the separation membrane, and the abnormal condition-judging means so judges that an abnormal condition is occurring in the fuel separation apparatus due to a drop in the function of the separation membrane when it has been so judged that no abnormal condition is occurring in the flow rate-adjusting means and when the rate of forming the high-octane fuel after the separation is smaller than a predetermined lower limit value.

* * * * *